US005941027A

United States Patent [19]

Hallsten

[11] Patent Number: 5,941,027

[45] Date of Patent: Aug. 24, 1999

[54] ACCESS PANEL ON DECK STRUCTURE

[75] Inventor: Jeffrey A. Hallsten, Sacramento, Calif.

[73] Assignee: Hallsten Corporation, Sacramento, Calif.

[21] Appl. No.: 08/907,552

[22] Filed: Aug. 8, 1997

[51] Int. Cl.[6] ..... E04B 1/344; E04B 7/16

[52] U.S. Cl. ..... 52/64; 52/71; 52/72; 52/246; 52/5; 52/650.3; 16/354

[58] Field of Search ..... 52/64, 246, 3, 52/5, 71, 471, 459, 650.3, 586.1, 72; 16/354

[56] References Cited

U.S. PATENT DOCUMENTS

| | | | |
|---|---|---|---|
| 4,679,277 | 7/1987 | Shibata | 16/354 |
| 5,050,361 | 9/1991 | Hallsten | 52/581 |
| 5,325,646 | 7/1994 | Hallsten . | |
| 5,337,451 | 8/1994 | Goosens | 16/354 |
| 5,513,472 | 5/1996 | Olsen et al. | 52/177 |
| 5,526,620 | 6/1996 | Hallsten | 52/246 |
| 5,570,971 | 11/1996 | Rixen et al. | 403/381 |
| 5,617,677 | 4/1997 | Hallsten . | |
| 5,636,893 | 6/1997 | Wheatley et al. | 16/354 X |
| 5,647,184 | 7/1997 | Davis | 52/592.1 |

FOREIGN PATENT DOCUMENTS

| | | | |
|---|---|---|---|
| 1542-244 | 3/1979 | United Kingdom | 52/71 |

*Primary Examiner*—Christopher Kent
*Assistant Examiner*—Brian E. Glessner
*Attorney, Agent, or Firm*—Thomas M. Freilburger

[57] ABSTRACT

A deck structure is assembled of a plurality of modular panels including one or more hinged, openable access panels. The panels, comprised of extruded deck planks and framing channels are interconnected at edges. At each access panel a gear hinge connects the panel with the adjacent fixed panel, through the width of the panels. Hinge gears are integrally formed on edges of a hinged plank and a fixed plank of the adjacent hinged and fixed panels, with a keeper member holding the gears enmeshed during opening and closing of the panel. In a preferred embodiment a gas tight seal is formed when the access panel is closed. The gear hinge comprising the hinged and fixed planks is the same width as other planks in the deck structure thereby allowing interchangeability and modularity in building the deck structure and allowing the hinge to be placed anywhere in the deck structure. An articulated, sliding cover using similar gear hinge components is also disclosed.

3 Claims, 11 Drawing Sheets

16
20
14
23
12
16
18
18
18
18a
25
26
22
19
11
32
30
21
17
10

26
32
46
42
34
30
44
40
22
23
19a
19a 26
32
34
30
22

ACCESS PANEL ON DECK STRUCTURE

BACKGROUND OF THE INVENTION

This invention is concerned with modularly assembled deck structures in which one or more panels of the deck are openable as access panels to the space below. In particular, the invention relates to such a deck structure formed entirely of aluminum extrusions, and, in a preferred embodiment, such a structure covering a tank with a substantially gas tight seal.

In prior deck or cover systems, particularly those covering a tank to substantially contain noxious or odorous gases therein, an access panel required a fair amount of time and expense for inclusion in the assembled deck structure. If a deck structure were assembled of the type generally described herein, formed of aluminum extrusions, the inclusion of a hinged access panel would generally require the use of stainless steel hinges, with drilling and bolting or riveting of the hinges into place on each of a fixed panel and the access panel. Further, if a relatively wide panel hinged in this way were lifted by one corner, it would tend to warp and would not lift smoothly because of all the force being applied, against the weight of the panel, unevenly at one corner.

SUMMARY OF THE INVENTION

In accordance with the invention described herein, a deck structure is assembled of modular panels, preferably of assembled aluminum extrusions, with one or more hinged access panels provided. Extruded parallel deck planks framed at ends by framing channel extrusions form each panel, which may be prefabricated at a plant. The planks or slats themselves preferably are interconnected at edges, along the length of the planks, for increased strength and minimizing of deflection under load.

At least one of the panels of the deck structure is a hinged access panel located adjacent to a fixed panel. Between the access panel and the fixed panel is a gear hinge comprising a fixed plank as an edge plank of the fixed panel and a hinged plank as an edge plank of the hinged access panel. An elongated hinge gear is integrally formed on each of the fixed plank and the hinged plank, the gears being engaged and extending substantially through the width of the adjacent panels. Thus, when the hinged access panel is opened, the torque from lifting the edge of the panel is transmitted through the length of the hinge and thus through the width of the panel, providing for smoother and easier opening of the panel from one corner.

Gear keeper means are provided to surround and contact both gears for retaining the gears in engagement as the hinged access panel is opened from a closed position of substantial planar alignment with the fixed panel, to a fully opened position. In a normal installation the panel fully opens to a position inverted and lying atop the fixed panel, i.e., folded back 180°.

The panels are preferably made of extruded aluminum components. As a result of the aluminum construction, the hinge is extremely strong especially in light of its relatively small size. As noted above, an advantage of the invention is that a user can lift one corner of the hinged panel and the panel will open evenly across the width because the lifting torque is spread continually along the hinge axis. The hinge will not bind. Further, using the hinged panel of the invention alleviates any need to assemble conventional hinges onto the panels with fasteners, thus eliminating the need for skilled workers in assembly of the deck and making on-site assembly of the deck structure simpler. The hinge is an integral part of the deck system, essentially flush-mounted. In addition, the cap or keeper is self-cleaning, tending to work out any sludge in the gears as the panel is opened and closed.

In a preferred embodiment a module comprising the hinged plank and the fixed plank is the same width as any other plank in the deck structure. Thus, the hinge module is fully interchangeable with any of the other planks in the deck.

In preferred embodiments the free end of the hinged panel can rest on an adjacent panel by means of an elastomeric connector which slides into the extrusion of the adjacent panel. This connection has the same panel-to-panel clearance as would a normal panel-to-panel elastomeric connector as disclosed in Hallsten Pat. No. 5,617,677, which is incorporated by reference herein.

A substantially gas tight seal is achieved with the structure of the invention by provision of tongue and groove connections between the fixed plank and the hinged plank which engage when the access panel is closed. Flexible members are also used at the other three edges of the hinged access panel, to bear against fixed structure and to provide a generally gas tight seal.

In another aspect of the invention an articulated slidable cover is made up of the gear hinge components of the invention.

It is therefore among the objects of the invention to improve on the structure of hinged access panels in decks, particularly those covering tanks wherein a substantially gas tight seal is desired. This is accomplished through the use of a gear hinge, with the gears integrally formed in aluminum extrusions which themselves form a part of the fixed panel and the hinged access panel, with sealing achieved by a tongue and groove connection between the adjacent fixed and hinged planks. These and other objects, advantages and features of the invention will be apparent from the following description of a preferred embodiment, considered along with the accompanying drawings.

DESCRIPTION OF PREFERRED EMBODIMENTS

Figure 1:
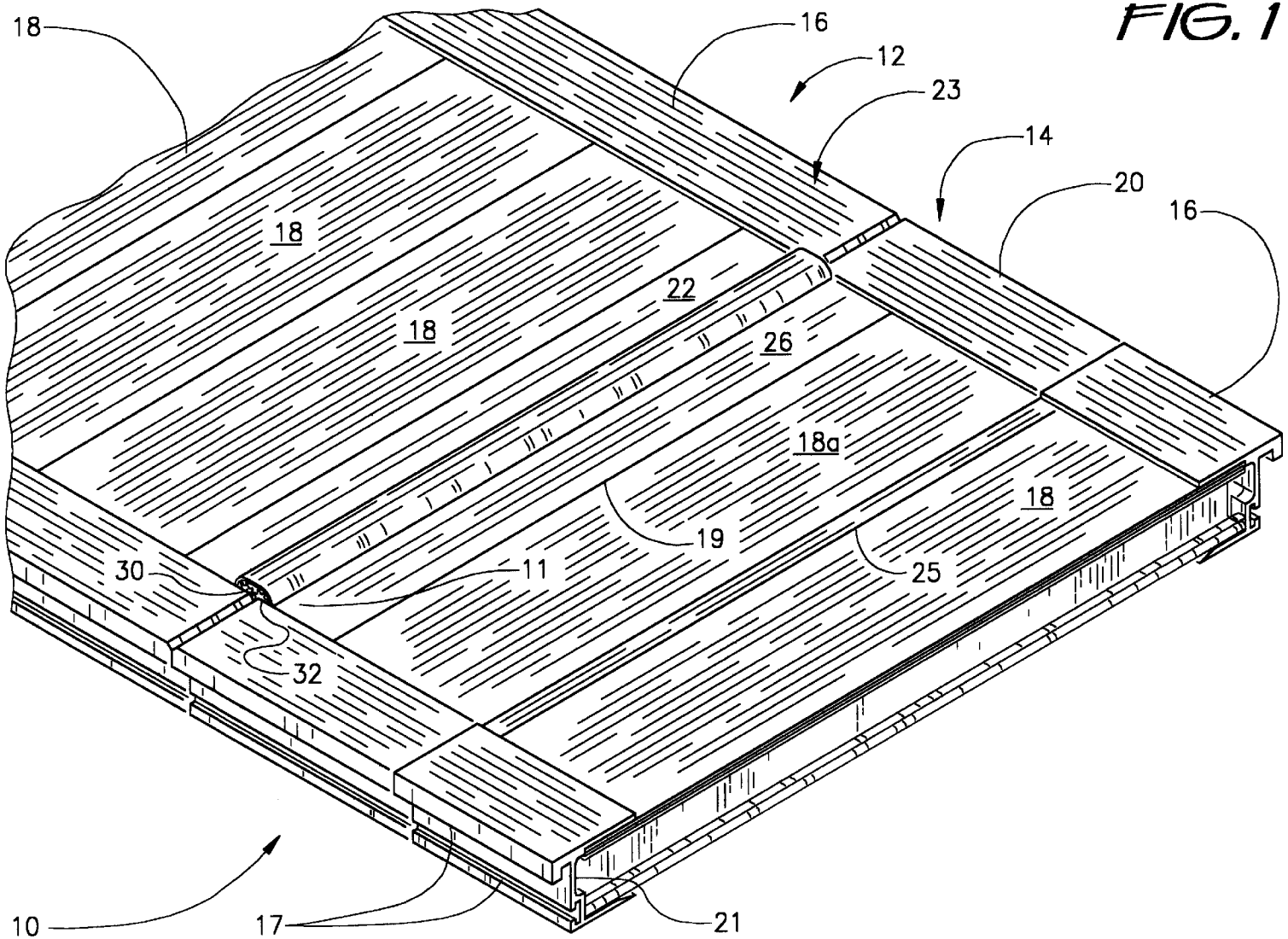
FIG. 1 is a perspective view showing a part of a deck structure including a gear hinge and hinged access panel, the panel being shown in a closed position.

FIG. 1 shows a deck structure 10 including a gear hinge 11 interconnecting a fixed panel 12 and an openable access panel 14. Panels 16 are regular fixed panels. Each panel is comprised of extruded parallel deck planks or deck slats 18 preferably interconnected along edges 19 and also held together by framing channel extrusions 20 which extend across all plank ends in a particular panel. The framing channel extrusions 20 each have a channel 21 for receiving the ends of the deck planks 18 thus supporting the deck planks from their ends and helping hold together the panel. Channel dimensions preferably are selected such that a firm, substantially gas tight fit may be obtained between planks 18 and framing channel extrusions 20, although sealing material may be applied as joints are made. Such a seal makes the deck panels of the invention useful as sewage treatment covers. The framing channel extrusions 20 may have an interconnecting configuration 17 similar to that disclosed in U.S. Pat. Nos. 5,325,646 and 5,617,677 referenced above, for connecting them and thus the panels 12, 14, 16 to other panels or to fixed structure at the edges of a tank or channel The deck planks 18 have edge connection structure 19*a* (seen in FIGS. 2–8) as disclosed in the above-referenced Patents, both incorporated herein by reference.

Figures 2, 3:
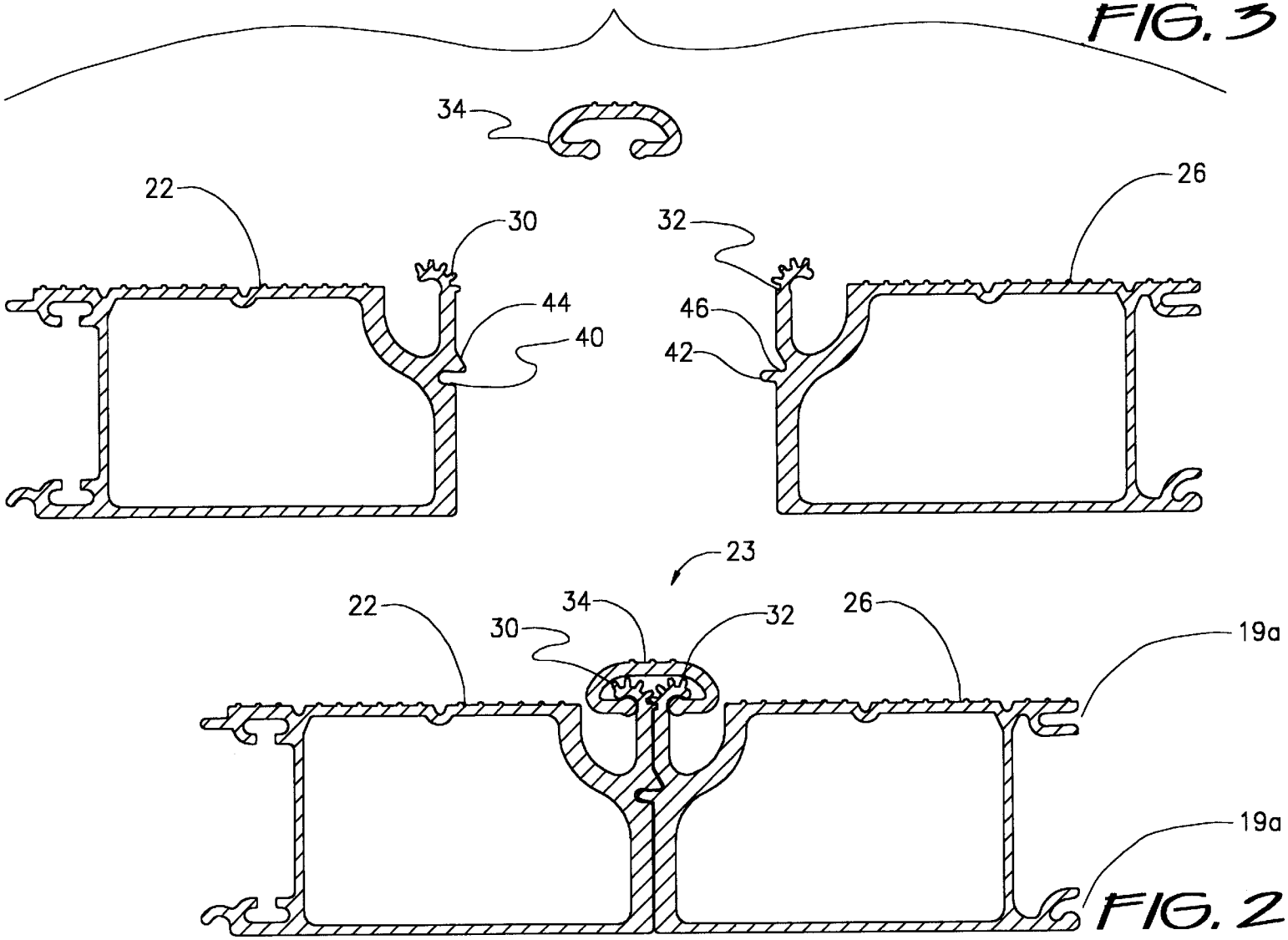
FIG. 2 is a schematic side elevation view showing a gear hinge module for use in the deck structure, to form edges of a fixed panel and an access panel.
FIG. 3 is an exploded side elevation view showing the same gear hinge module depicted in FIG. 2.
Figure 5:
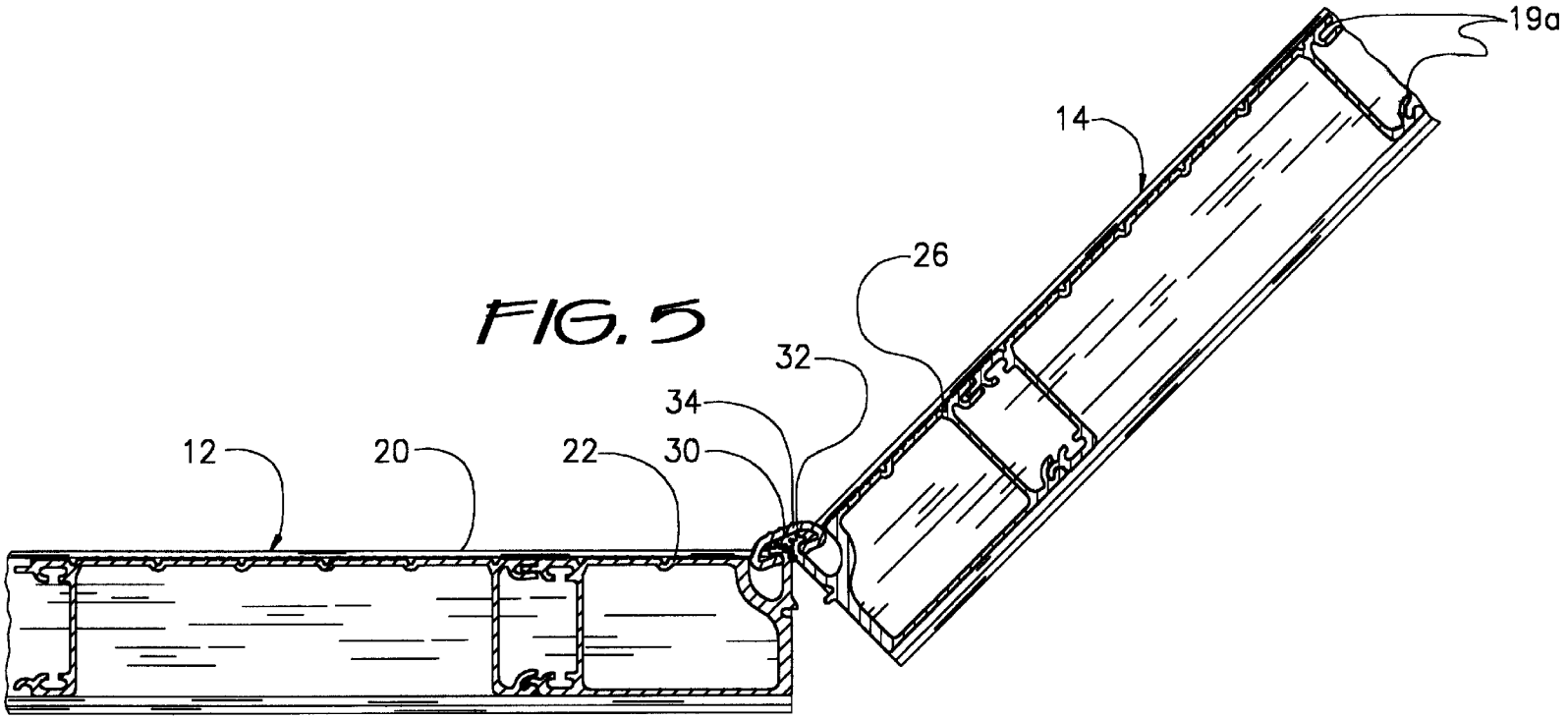
FIG. 5 is a view similar to FIG. 4, but with the access panel being slightly opened.

The fixed panel 12 comprises a series of regular planks 18 and a special fixed edge plank 22 which forms part of a hinge module 23 shown in FIG. 2. The access panel 14 includes a series of regular planks 18 and a special hinged plank 26 forming part of the hinge module 23. At the outer, free end of the hinged panel, an edge plank 18*a* seals against an adjacent fixed plank 18. An elastomeric gasket 25 (which may be of the type shown in FIG. 26 of Pat. No. 5,617,677) may extend toward the hinged panel, the gasket being secured to the fixed plank as shown in that patent. The lower protruding flange of the plank 18*a* is removed to allow the panel to close with the upper flange of the plank 18*a* resting on the gasket 25.

The gear hinge 11 is formed of a first elongated hinge gear 30 and a second elongated hinge gear 32, each hinge gear integrally formed on each of the fixed plank 22 and the hinged plank 26 as better seen in FIGS. 2 and 3. (FIG. 1 shows the size and upward protrusion of the gear hinge not to scale, for purpose of illustration.) The gears 30, 32 are enmeshed and extend substantially through the width (parallel to the gear hinge and to the length of the planks) of the fixed and hinged panels 12 and 14. A gear keeper member 34 is fitted around both gears 30, 32 (by sliding assembly) to retain the gears in engagement and the two panels in adjacent relationship as the hinged access panel 14 is opened.

Figure 4:
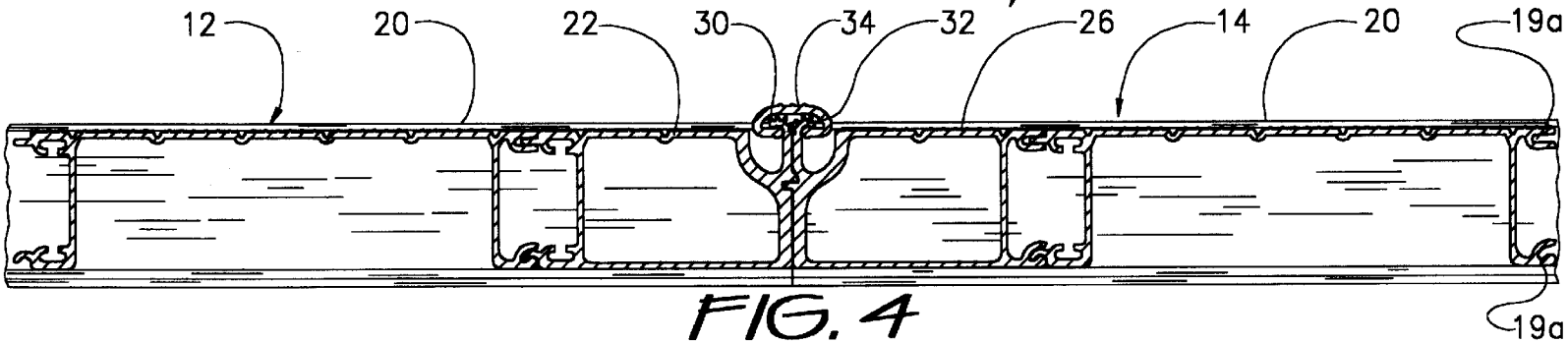
FIG. 4 is a side elevation view showing portions of two adjacent panels connected by the gear hinge, with the access panel being in a closed position.
Figures 6, 7:
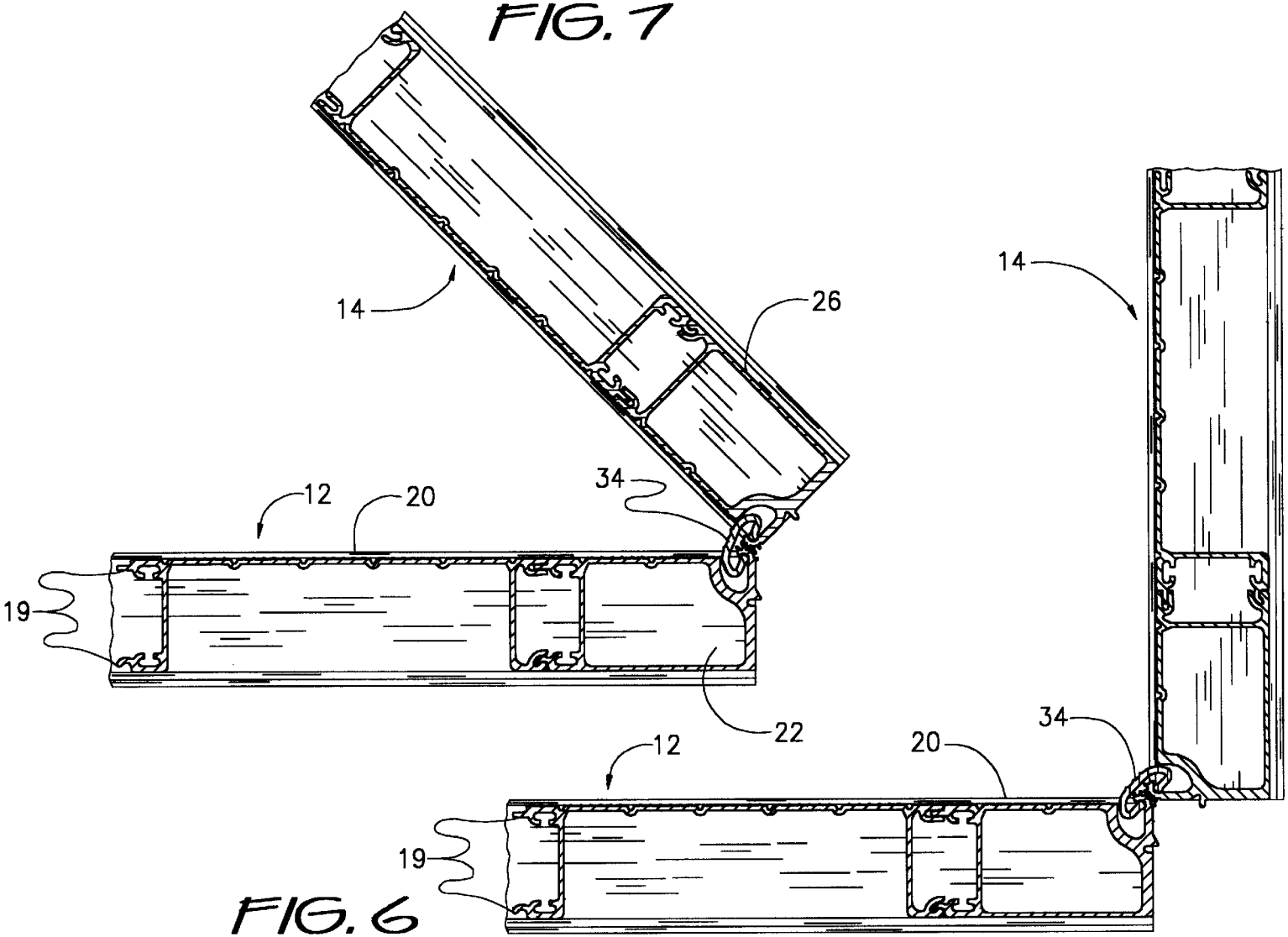
FIG. 6 is another view similar to FIG. 4, but with the access panel being opened about 90° from the closed position.
FIG. 7 is another view similar to FIG. 4, but with the access panel opened beyond 90°.
Figure 8:
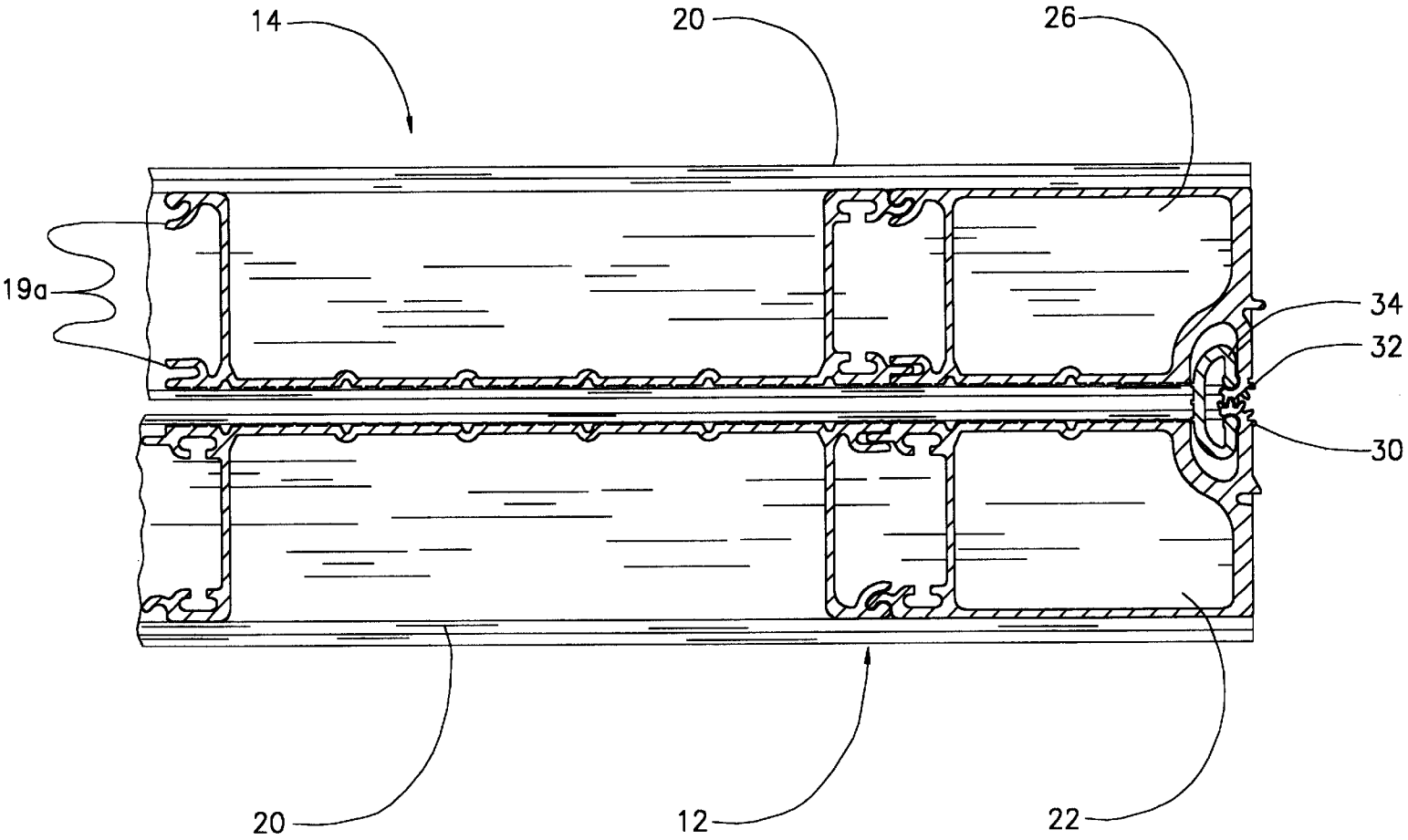
FIG. 8 is another similar view, but with access panel in a fully opened position folded back on the fixed panel.

In FIG. 4, the access panel 14 is shown in closed position, i.e., in substantial planar alignment with the fixed panel 12. As the access panel 14 is opened as seen in FIGS. 5, 6, 7 and 8, the gear keeper 34 retains the gears 30, 32 in engagement. When the access panel 14 is fully opened (FIG. 8), in most cases it is inverted and lies atop the fixed panel 12, generally in a 180° rotated position from the closed position (FIG. 3). However, there can be situations in which a fully open position is between 90° and 180°, if some obstruction is present.

As also shown in FIG. 4 (and FIG. 1), the hinge module 23, with the hinged plank 26 and the fixed plank 22, is preferably of the same width as each regular plank 18, therefore being fully interchangeable with any plank and allowing a hinge module to be placed anywhere on the deck structure to form an access panel. For example, a hinge module 23 can be inserted in a panel so as to divide the panel into two halves—the fixed panel 12 and the hinged access panel 14.

In a preferred embodiment a substantially gas tight seal is created between the fixed plank 22 and the hinged plank 26 by a dual tongue and groove sealing arrangement. The fixed plank 22 has a continuous groove 40 which seals with a continuous tongue 42 of the hinged plank 26, and the hinged plank 26 has a groove 46 which engages with a tongue 44 on the fixed plank 22, thereby creating an essentially gas tight seal. Sprayed-on coatings can be applied to the tongues and/or grooves to enhance sealing.

All framing channel extrusions 20 and deck planks 18, 22, 26 are preferably extruded of aluminum. It will be evident to those familiar with the art that a hinged panel can be provided in a deck structure from materials such as wood or steel, and assembled using traditional connections, such as welds, screws or bolts. However, it is desired that the hinged panel of the present invention be field erectable, at the location at which it is used, without the need for personnel having special skills. Because of this, and because of the efficient operation of a gear hinge in the context of openable deck panels, the described gear hinge is particularly advantageous in the described context, formed from lightweight components and assembled preferably without welds and with few or no bolted connections.

Figure 9:
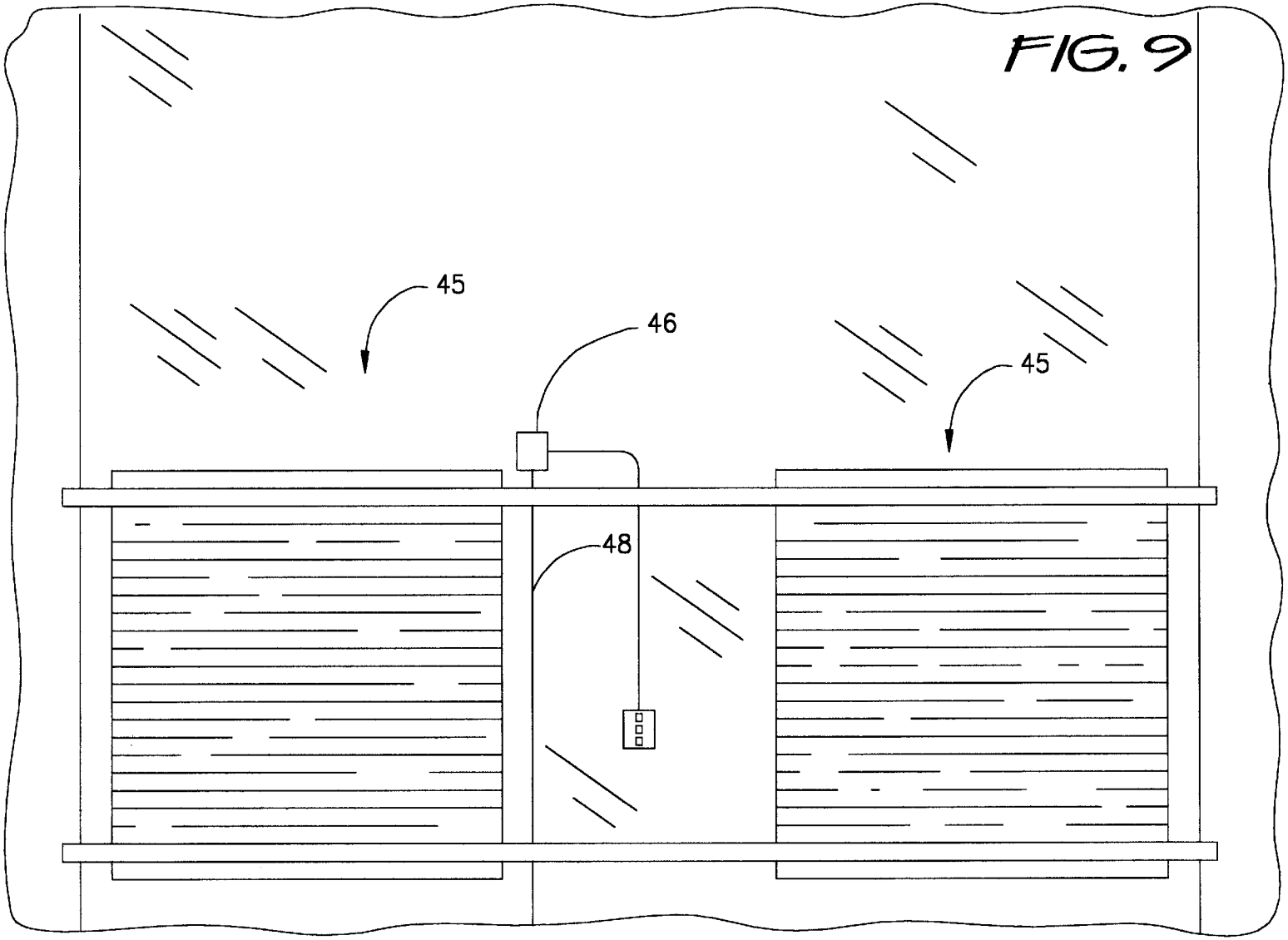
FIG. 9 is a plan view showing a hopper cover and illustrating one embodiment of the invention wherein the hopper cover is articulated and formed of slat components connected by gear hinges of the invention.

FIGS. 9–14 show an articulated cover using the gear hinges of the invention. The articulated cover 45, two of which are shown in FIG. 9, is illustrated in the context of a hopper cover having a slope, although the cover can be horizontal or in other configurations if desired. As indicated in FIG. 9, the articulated cover is operated by an electric drive motor 46 which rotates a threaded drive shaft 48 to raise or lower the cover, as shown in greater detail in subsequent drawings.

Figure 10:
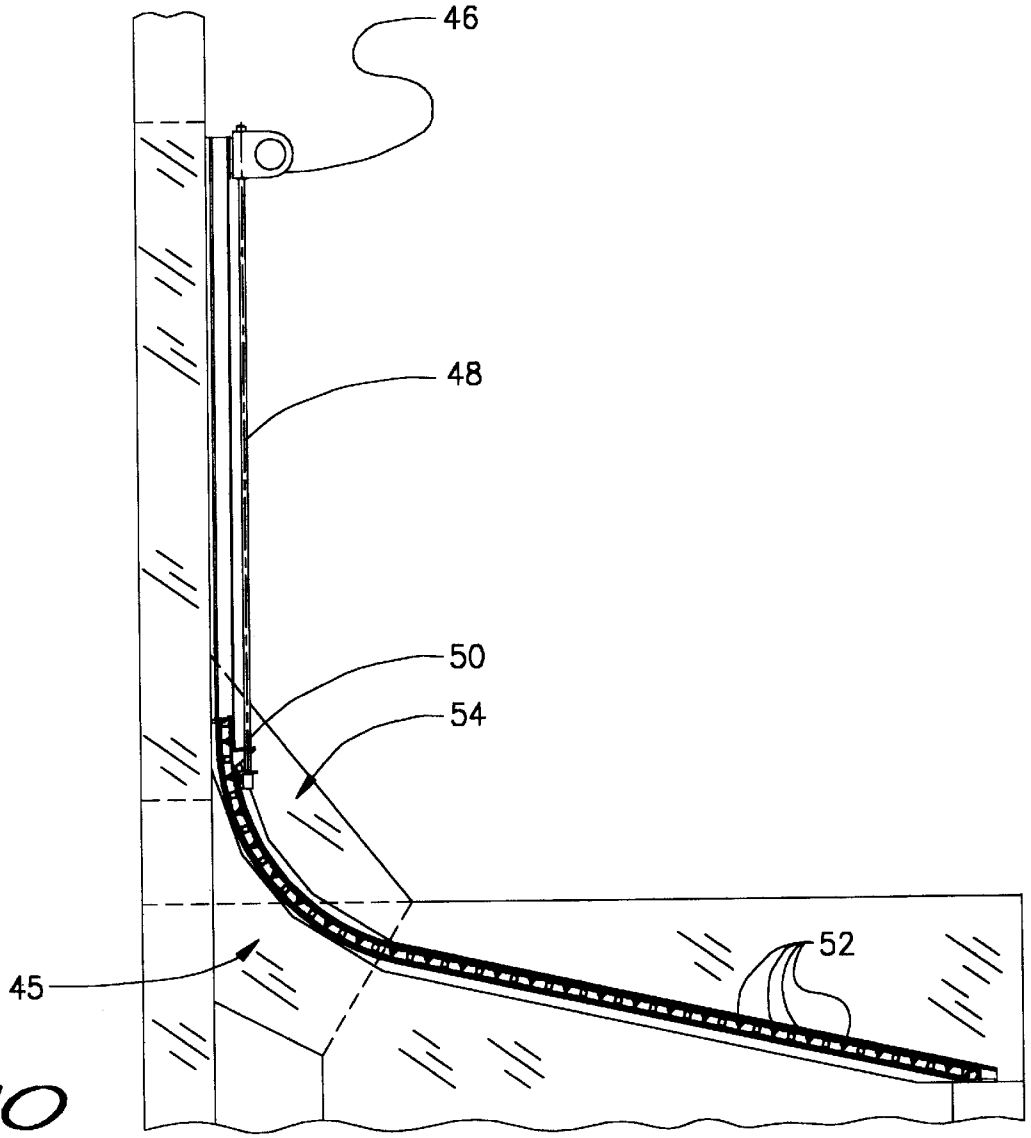
FIG. 10 is a side elevation view showing such an articulated hopper cover in the closed position.
Figure 11:
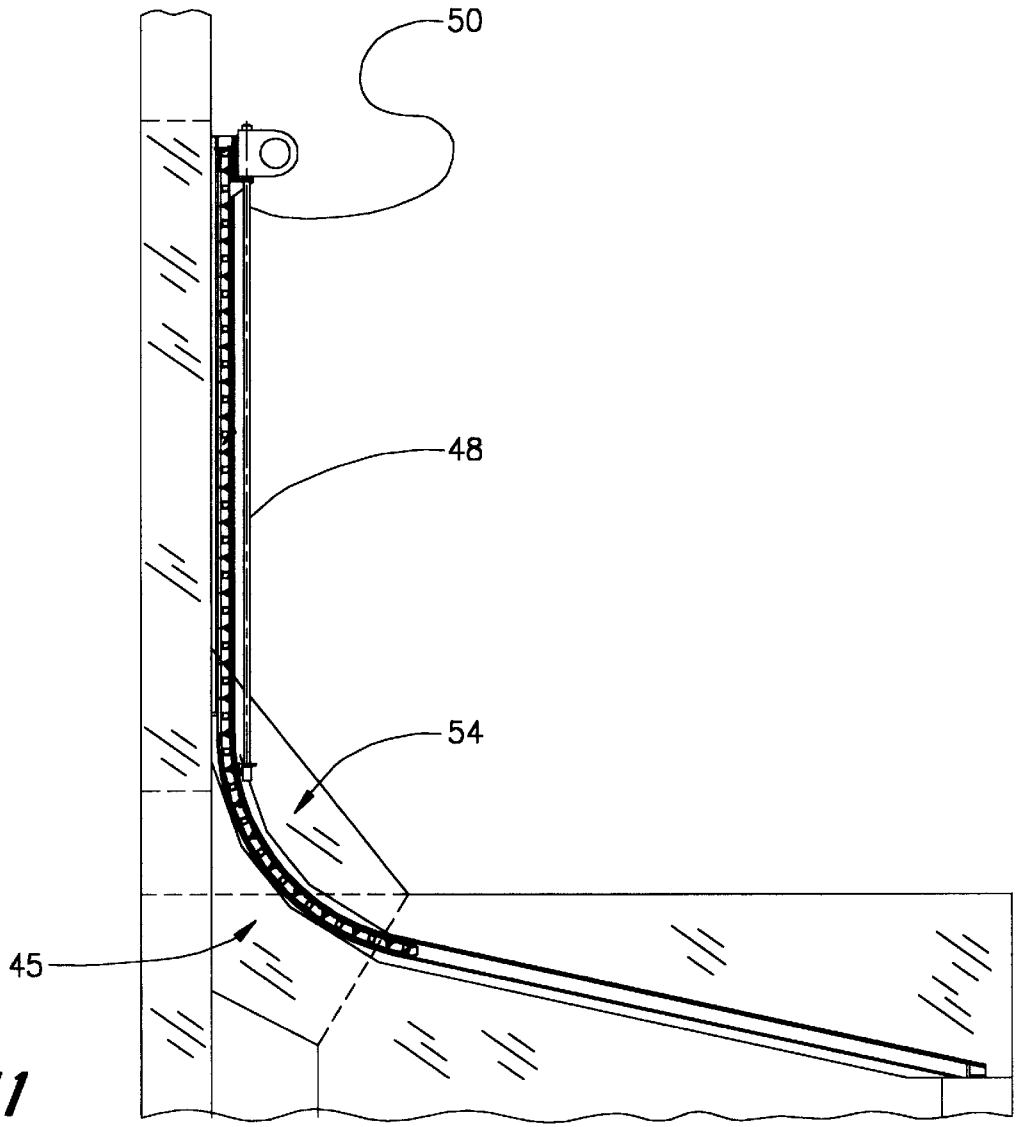
FIG. 11 is a view similar to FIG. 10, showing the articulated hopper in the open position.

FIGS. 10 and 11 show the articulated cover in closed and opened positions, respectively. The threaded drive shaft 48 cooperates with a threaded receiving connection 50 fixed near the upper end of the articulated cover. The articulated cover 45 has a multiplicity of joints 52 allowing articulation or bending of the cover as it passes around a generally cylindrical curve area 54.

Figure 12:
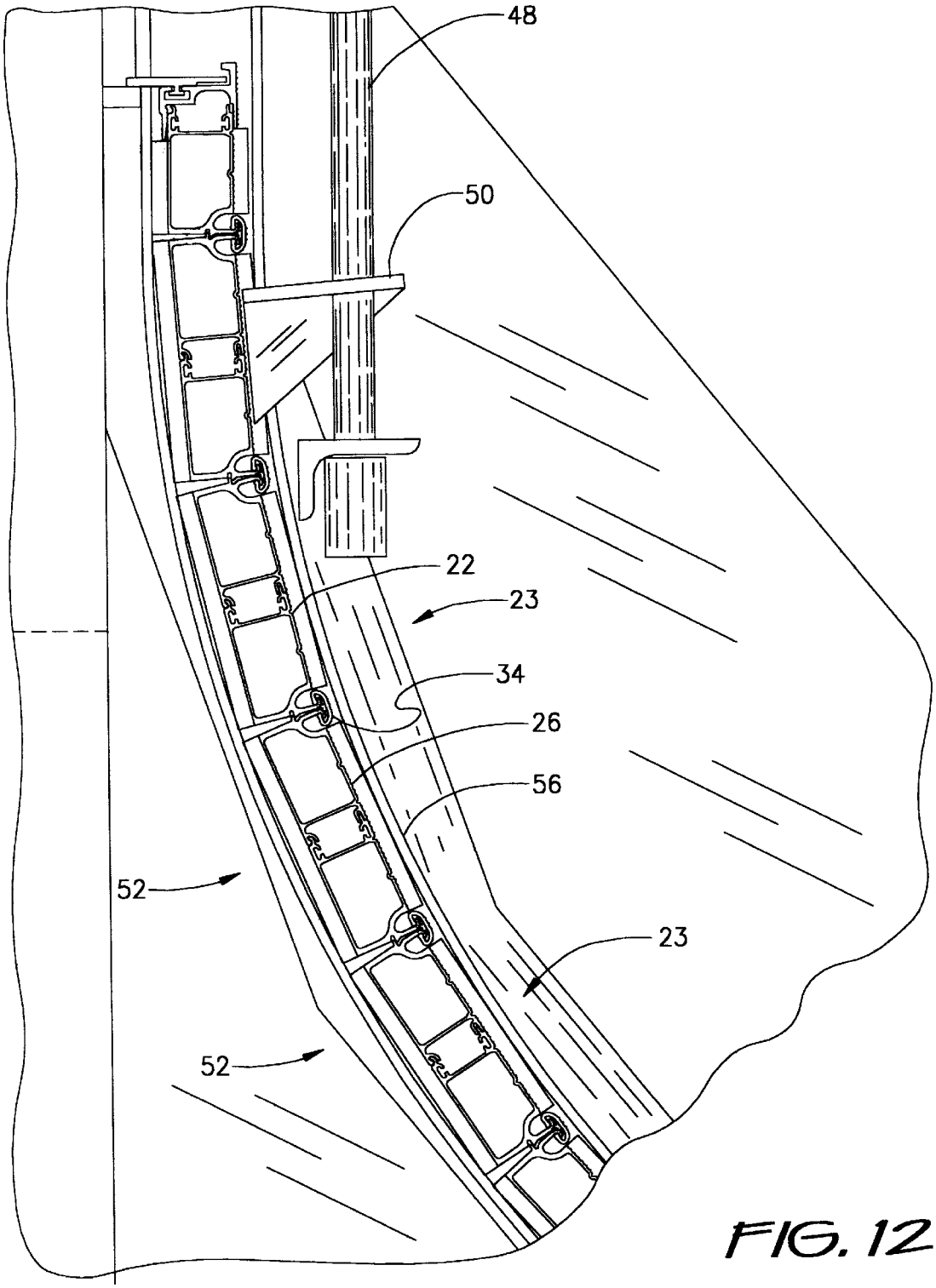
FIG. 12 is an enlarged side elevation view showing a portion of the articulated hopper cover shown in FIG. 10.
Figure 13:
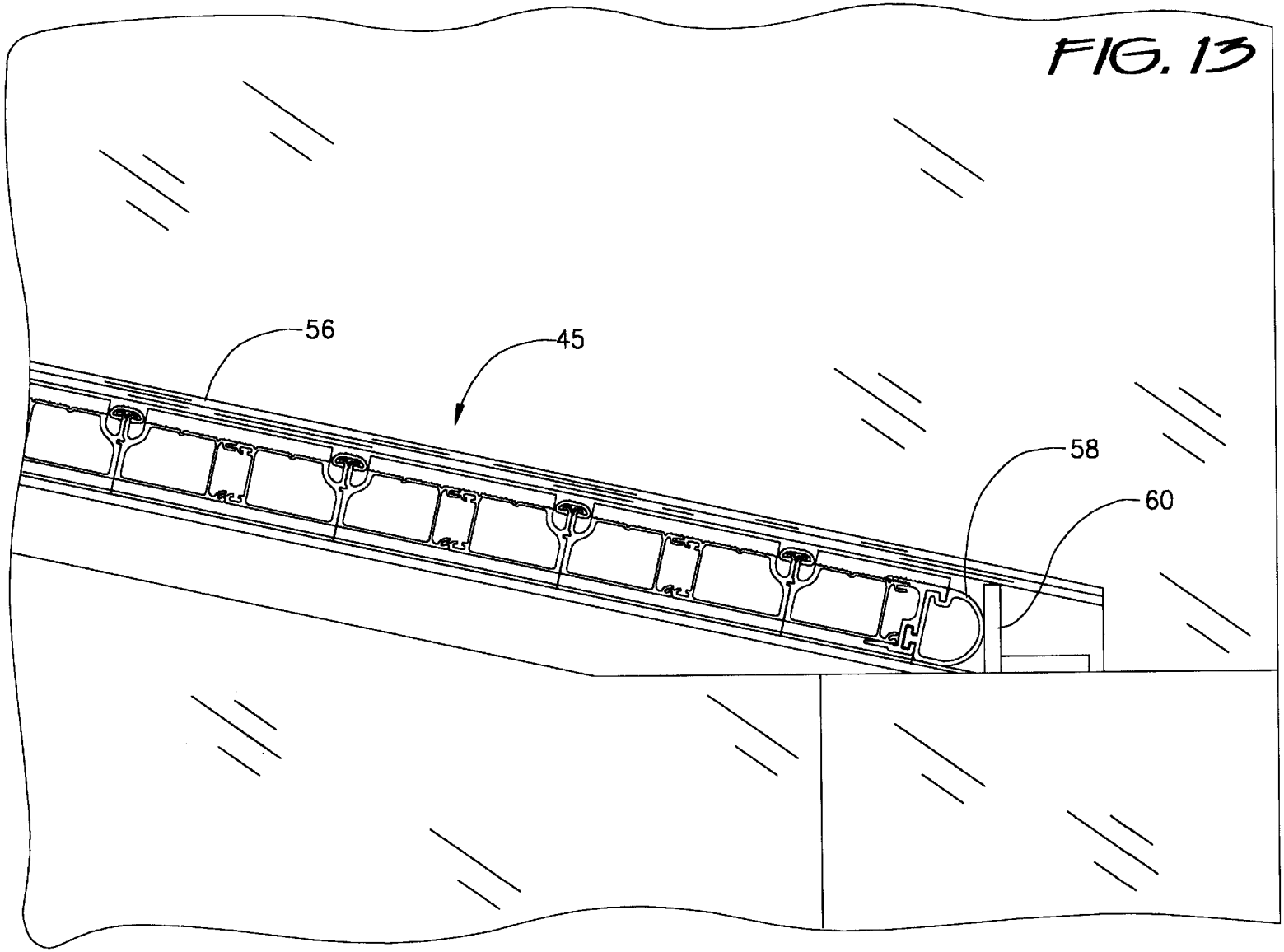
FIG. 13 is an enlarged side elevation view showing another portion of the hopper cover of FIG. 10.

FIGS. 12 and 13 show portions of the articulated cover, within a guide channel 56, in greater detail. As can be seen from FIGS. 12 and 13, at each of the many joints 52 of the articulated cover, a gear hinge of the invention is incorporated, similar to what is shown in FIGS. 2 and 3. Each gear hinge assembly has planks 22 and 26, along with the remaining components described above. Instead of being connected in a panel as in the earlier described drawings, the plank sections 22 and 26 on each side of the actual hinge simply connect with an-adjacent gear hinge assembly. In this way, the gear hinges are closely spaced and allow the tank cover or hopper cover to operate in the manner of a roll-top desk, with substantially gas tight seals at each articulated joint 52.

FIG. 13 shows an elastomeric gasket 58 at the bottom end of the articulated cover 45, abutting against a fixed stop 60.

Figure 14:
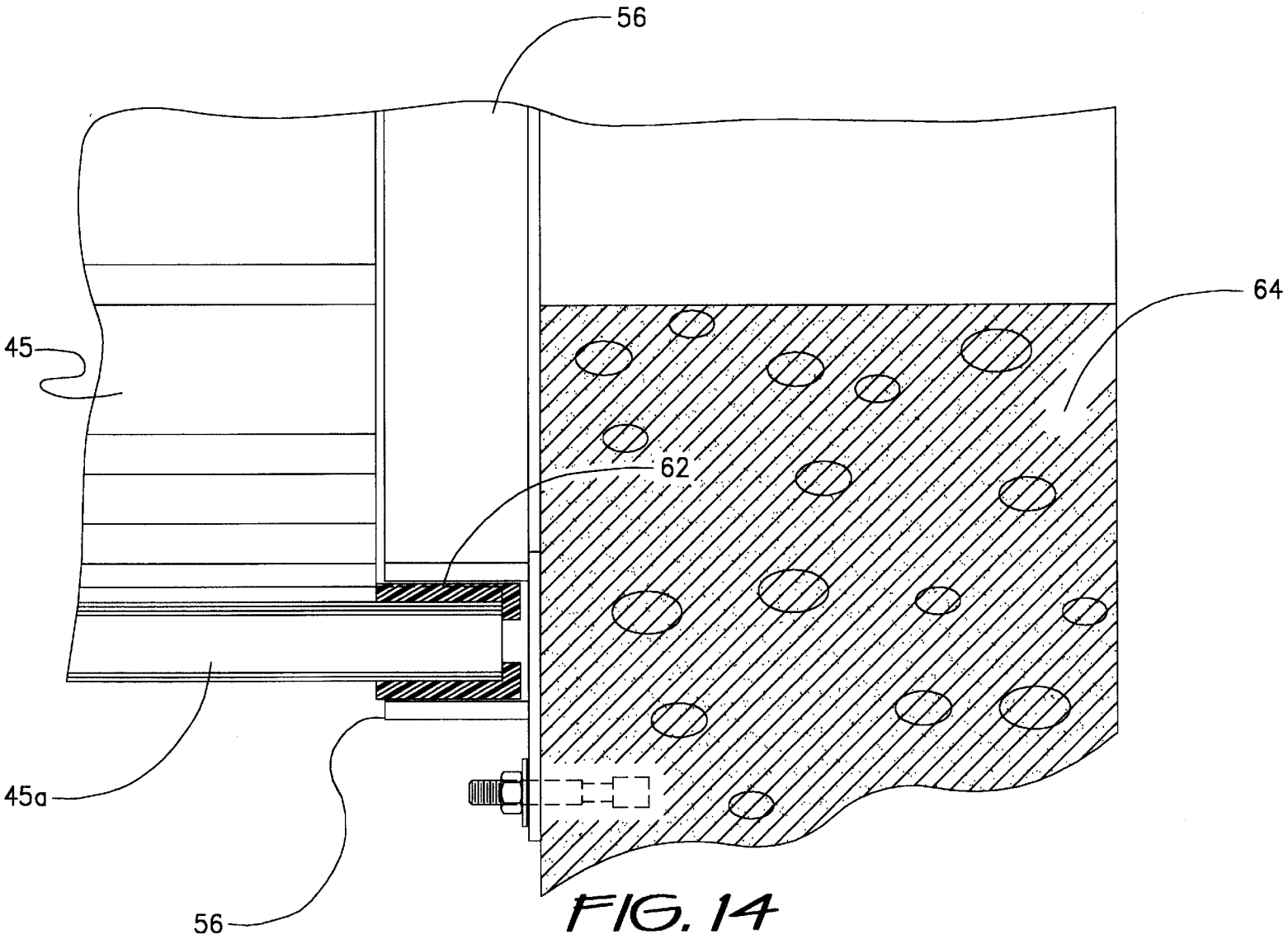
FIG. 14 is a sectional view showing a guide channel which guides the movement of the articulated hopper cover during opening and closing.

FIG. 14 is a detail indicating an arrangement for guidance of the articulated cover through the guide channel 56. The articulated cover is partially shown generally in plan and partially shown in cross section, the cross section being indicated at 45*a*. The gear hinge assemblies 23 with the associated planks have a pair of glides continuously mounted on top and bottom of the cover at the edge, these glides being shown at 62 in FIG. 14. The glides are affixed to the cover in a sandwich arrangement and may comprise UHMW polyethylene. As the cover is opened or closed, these polyethylene glides slip against the interior surfaces of the guide channel 56, which is mounted on fixed structure such as the concrete basin 64 illustrated in FIG. 14.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A deck structure assembled of panels and providing access to space below the deck via one or more hinged, openable access panels, comprising:

a plurality of panels comprised of extruded parallel deck planks, with framing channel extrusions engaging ends of the deck planks to support the deck planks and hold the panel together, the deck planks having edge connection means for interconnecting edges of adjacent planks through the length of the planks, and the panels being connected at edges, some of the panels being fixed panels, and at least one of the panels being a hinged access panel adjacent to a fixed panel, and including a gear hinge formed between the access panel and the fixed panel, the gear hinge comprising a) a fixed plank as an edge plank of the fixed panel b) a hinged plank as an edge plank of the hinged access panel c) first and second elongated hinge gears integrally formed on each of the fixed plank and the hinged plank, the gears being engaged and extending substantially through the length of the fixed and hinged panels, d) gear keeper means secured against both gears for retaining the gears in engagement as the hinged access panel is opened from a closed position of substantial planar alignment with the fixed panel, to a fully opened position in which the access panel is inverted and lies atop the fixed panel.

2. The deck structure of claim 1, in combination with a tank carrying noxious or odorous materials, the deck structure serving as a cover for the tank, and including means for providing a substantially gas tight seal between the connected extrusions of the deck structure and at edges of the hinged access panel.

3. The combination defined in claim 2, wherein the gas sealing means comprises, between adjacent deck planks, tongue and groove connection means as part of said edge connection means, and at the juncture between the fixed plank and the hinged plank, tongue and groove sealing means for engaging a side edge of the fixed plank with a side edge of the adjacent hinged plank when the hinged access panel is in the closed position.

* * * * *